US007011018B2

(12) United States Patent
Schroeder et al.

(10) Patent No.: US 7,011,018 B2
(45) Date of Patent: Mar. 14, 2006

(54) MATERIAL COMPACTION APPARATUS

(75) Inventors: Duane G. Schroeder, New Hope, MN (US); Raymond J. Koski, Andover, MN (US)

(73) Assignee: Kurt Manufacturing Company, Inc., Minneapolis, MN (US)

( * ) Notice: Subject to any disclaimer, the term of this patent is extended or adjusted under 35 U.S.C. 154(b) by 0 days.

(21) Appl. No.: 10/767,883

(22) Filed: Jan. 29, 2004

(65) Prior Publication Data

US 2005/0109226 A1 May 26, 2005

Related U.S. Application Data

(63) Continuation-in-part of application No. 10/138,190, filed on May 1, 2002.

(60) Provisional application No. 60/287,820, filed on May 1, 2001, provisional application No. 60/316,145, filed on Aug. 30, 2001, provisional application No. 60/443,702, filed on Jan. 29, 2003.

(51) Int. Cl.

| | |
|---|---|
| ***B30B 9/04*** | (2006.01) |
| ***B30B 11/02*** | (2006.01) |
| ***B30B 15/22*** | (2006.01) |

(52) U.S. Cl. ..... 100/191; 100/37; 100/41; 100/50; 100/127; 100/145; 100/215; 100/226; 100/232; 100/233; 100/906

(58) Field of Classification Search ..... 100/41, 100/42, 50, 110, 215, 226, 232, 233, 240, 100/242, 179, 191, 192, 906, 145, 127, 37; 210/359, 446

See application file for complete search history.

(56) References Cited

U.S. PATENT DOCUMENTS

| | | | | |
|---|---|---|---|---|
| 680,841 | A | | 8/1901 | Chapman |
| 2,332,170 | A | * | 10/1943 | Sapp ..... 425/311 |
| 2,596,872 | A | * | 5/1952 | Skromme ..... 100/191 |
| 3,070,006 | A | | 12/1962 | Raney et al. |
| 3,090,182 | A | | 5/1963 | Johnson |
| 3,350,999 | A | | 11/1967 | Morse |
| 3,765,321 | A | | 10/1973 | Newell |
| 3,866,529 | A | * | 2/1975 | Holman ..... 100/43 |
| 3,980,014 | A | | 9/1976 | McEwen et al. |
| 4,037,528 | A | * | 7/1977 | White et al. ..... 100/191 |
| 4,059,049 | A | | 11/1977 | Tillgren |
| 4,080,889 | A | | 3/1978 | Shiloni |
| 4,100,849 | A | * | 7/1978 | Pelton ..... 100/41 |
| 4,162,603 | A | | 7/1979 | Stromberg |
| 4,557,190 | A | | 12/1985 | Vezzani |
| 4,594,942 | A | | 6/1986 | Denneboom |

(Continued)

FOREIGN PATENT DOCUMENTS

WO WO 2002/087864 A1 11/2002

*Primary Examiner*—Derris H. Banks
*Assistant Examiner*—Jimmy T. Nguyen
(74) *Attorney, Agent, or Firm*—Steven M. Koehler; Westman, Champlin & Kelly, P.A.

(57) ABSTRACT

The material compactor generally includes a feed apparatus and a final compaction apparatus. The final compaction apparatus generally includes a compaction chamber having confronting compression plates and an adjustably taperable portion. The area of the inner cavity of the final compaction chamber can be adjusted to become measurably smaller (tapered) or larger at the opened discharge or expelling end. Consequently, compacting movement of the material within the compaction chamber and through the chamber significantly subjects the material to restrictive compacting pressure which in turn compacts the material and performs liquid separation with each operationally continuous movement through the final compaction apparatus and out an open discharge port.

27 Claims, 8 Drawing Sheets

U.S. PATENT DOCUMENTS 4,603,909 A 8/1986 Le Jeune
4,897,194 A 1/1990 Olson
5,173,196 A 12/1992 Macrae
5,322,009 A 6/1994 Retrum
5,365,838 A 11/1994 Valentini
5,391,069 A 2/1995 Bendzick
5,461,975 A * 10/1995 Driggs ..... 100/188 R
5,542,348 A 8/1996 Bendzick
5,662,036 A 9/1997 Daniel
5,664,491 A * 9/1997 Maki et al. ..... 100/41
5,664,492 A 9/1997 Bendzick
5,694,742 A 12/1997 Elliott et al.
5,735,197 A 4/1998 Kleine
5,832,815 A 11/1998 Bollegraaf
6,152,027 A 11/2000 Segura
6,272,981 B1 8/2001 Murata et al.
6,349,638 B1 2/2002 Thompson
2003/0024861 A1 2/2003 Schroeder et al.

* cited by examiner

MATERIAL COMPACTION APPARATUS

RELATED APPLICATIONS

This application is a Continuation-In-Part of application Ser. No. 10/138,190, filed May 1, 2002, entitled "MATERIAL COMPACTION APPARATUS", which in turns claims priority to Provisional Patent Application Nos. 60/287,820 filed May 1, 2001 and 60/316,145, filed Aug. 30, 2001 and this Application also claims benefit of U.S. Provisional Patent Application No. 60/443,702, filed Jan. 29, 2003, entitled "MATERIAL COMPACTION APPARATUS", with each of said applications being incorporated herein by reference in their entirety.

FIELD OF THE INVENTION

This invention relates to material compaction and liquid separation. More particularly, this invention relates to the compaction of various materials, and the removal of various liquids from in and around those materials by pushing the materials and liquid through a gateless, adjustably taperable chamber.

BACKGROUND OF THE INVENTION

In the manufacturing process, metals and other materials can be manipulated through various machining processes. During these processes, liquids are often applied to serve as lubricants and coolants. Depending on the material composition and the specific manufacturing needs, the liquid can be quite costly. The process inevitably results in waste consisting of material and liquid. Any material or liquid that can be saved and reused, or properly disposed of, can provide significant savings.

Costs associated with the disposal or recycling of the material waste are increased if liquid remains below or above the surface of the material following the manufacturing process. Liquid used during a specific process may leave a material unusable until that liquid has been nearly completely separated from the material. Further, an efficient and thorough separation of the manufacturing material and the liquid can assure that material and liquid reuse is maximized. This in turn makes it more likely that reusable material or liquid is not being disposed of with the unusable or unwanted waste.

Further, various governmental laws and regulations require proper disposal and removal of many defined materials and liquids. If these laws and regulations are not specifically followed, costly fines and other penalties may be imposed. An efficient separation and compaction process facilitates conformity with these requirements.

Conventional material compacting devices are so-called briqueting machines that carry out numerous steps to create a block of compacted material. The machines compact relatively comminuted shavings and scrap. The key to these machines is the repetitive hydraulic or mechanical steps that are performed on each block of material against a resistive gate.

These briqueting machines focus the compaction process on this repetitive gate system. Material waste is fed into a compaction chamber. This compaction chamber generally consists of a ramming device and a gate, at opposing ends. The material waste is fed into the chamber so that it rests in between the ramming device and the gate. One or more compaction stages are performed on the material. Generally, an initial compaction stage advances the ramming device under low pressure, loosely compacting the material under pressure against the gate. This ramming device will be driven by either hydraulic or mechanical means. The mechanical means can function in the same manner as a mechanical device (i.e., punch press), or other like devices, for repeatedly advancing the ramming device forward, thus pressing the material against the gate.

Following initial compression, a second compaction stage generally occurs where the loosely compacted waste is subject to high pressure from the ramming device against the gate. Desired compression levels and ramming steps and/or energy are directly related, and as such, a highly compacted mass of material requires significant ramming steps and/or exerted energy on the material. After compaction is complete the machine must engage in several motions or steps just to eject the material block and to set up for the next grouping of material. The ramming device must retract and the gate must be raised or relocated from its end position in the compaction chamber in order to allow for the ejection of the material. The ramming device is then operated at low pressure in a forward direction to discharge the compacted material waste from the compaction chamber. Upon discharge of the block, the ramming device and the gate must move back to their original positions in the compaction chamber. This repetitive process must be performed for each individual grouping of material loaded into the compaction chamber.

There is an innate inefficiency embodied within the processes utilized by these conventional compaction machines. Wasted motion and energy is inevitable within any of these systems that rely on a gate system. A continuous compaction process is impossible to achieve. The wasted movement of the ramming device within a gate system means that such a device will unnecessarily increase manufacturing time and energy costs. Any attempt to reduce the processes or ramming steps with these conventional machines will inevitably result in a reduction in the level of compaction and liquid separation.

Even when conventionally acceptable ramming steps and exerted energy levels are utilized, material compaction and liquid separation are not optimal. While the current machines do measurably compact and remove liquid from the surfaces and interior of the material waste, there is room for sizeable improvement. Consequently, a more efficient and effective machine is needed to minimize costs and to maximize material compaction and liquid separation.

SUMMARY OF THE INVENTION

The material compaction system and methods of the present invention substantially address and solve the innate problems of conventional compaction machines and methods. The compaction system in accordance with the present invention provides highly efficient and effective compaction that substantially minimizes costs associated with wasted manufacturing steps, while at the same time substantially maximizes material compaction and liquid separation.

The material compactor in accordance with the present invention generally includes an initial feed apparatus and a final compaction apparatus. The final compaction apparatus generally includes an adjustably taperable compaction chamber. The area of the inner cavity of the compaction chamber can be tapered to become measurably smaller or larger at the discharge/expelling end or port. Consequently, compacting movement of the material through the compaction chamber significantly subjects the material to compacting restriction, or funnelized pressure in those cases where there is a reducing taper, which in turn compacts the material and performs liquid separation with each operationally continuous movement of the material through the compaction apparatus. Even if there is no taper, or if there is a measurable increase in the chamber area at the discharge port, restriction occurs on the material within the limited confines of the chamber.

In one embodiment, area adjustment at the discharge port of the compaction apparatus is achieved through the use of a generally rectangular compaction chamber. The chamber is generally constructed of adjustable confrontable compression plates. These plates permit angular/tapered adjustments to the chamber to advantageously control restriction, or funnelizing pressure, through to the discharge port. The chamber is continuously open at the discharge port and compacted material may be continuously discharged out of this port following rigorous and repeated compaction.

An initial compaction stage can be provided with the use of the feed apparatus, such as a bin and at least one auger. The force-exerting movement of the material into and through the feed apparatus by way of the auger can provide for this initial compaction. The at least one auger may be a so-called "pig tail" auger, supported at its driven end and merely being rotatably disposed in an auger tube or feed channel at its discharge end. Further embodiments can direct the material through the first compaction stage utilizing chain feeds, conveyor systems, manual feeds, multiple auger systems, and other known devices and techniques. In addition, it is envisioned that the initial compaction can be conducted at a machine or manufacturing process distinct and/or separate from the machinery of the present invention and directed into the compaction apparatus. A material shredder may be operably connected to the feed apparatus such that at least some of the material within the apparatus is further shredded to facilitate movement of large, stringy, and/or clumped material groupings through to the compaction apparatus. Further, a second auger device can be implemented adjacent or proximate the first auger. The second auger can substantially rotatably operate in a reverse orientation to the first auger such that excess material can be fed back into the bin to maintain a circular feed operation.

Generally, the compaction apparatus includes a single ramming device to promote efficiency in motion and energy. A compaction ram or device is operably aligned for repeated movement through the compaction chamber of the compaction apparatus. Specifically, the ram drives the material through the inner cavity of the compaction chamber, thus repeatedly subjecting the material to the adjustable and confined area of the inner cavity through to the open discharge port.

The present invention provides for a nearly continuous feeding action of the compactable material through the machine and, particularly, through the compaction apparatus and out the discharging port of the corresponding compaction chamber. The process of feeding the material through the final compaction apparatus is only momentarily halted while a new grouping of material is fed into the chamber, during retreating of the ram from the compaction chamber.

DETAILED DESCRIPTION OF THE DRAWINGS

Referring to FIGS. 1–14, embodiments of a material compactor 10 in accordance with the present invention are shown. This material compactor 10 generally comprises an initial feed apparatus 12 and a compaction apparatus 16. In relevant figures, certain dashed lines are included to demonstrate the potential movement (i.e., the start and finishing positions) for corresponding movable components (i.e., rams, plates, and the like), and to show hidden structures. Various embodiments of the present invention include, in part at least, structure, functions, and devices described and disclosed previously by the present Applicant in U.S. patent application Ser. No. 10/138,190, and as a result said application is incorporated herein by reference in its entirety.

Figure 1:
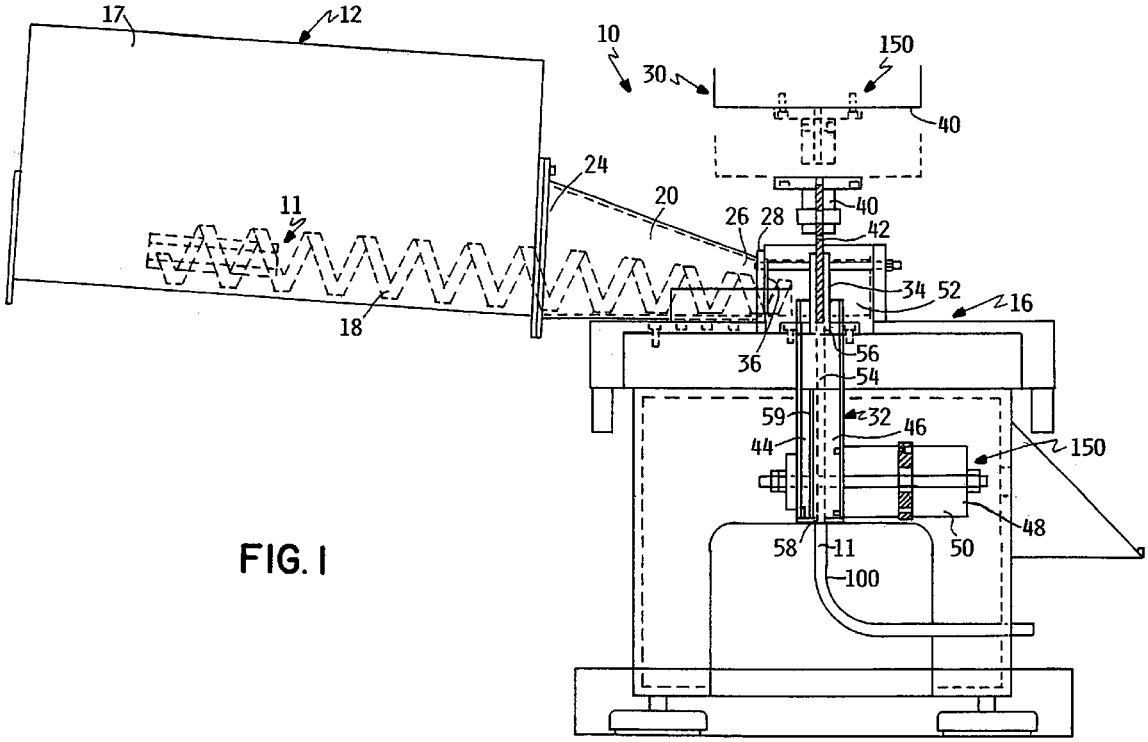
FIG. 1 is a side view of a material compaction apparatus in accordance with an embodiment of the present invention.

Referring primarily to FIG. 1, the feed apparatus 12 generally comprises a bin 17, at least one auger 18, and a feed channel or auger tube 20. The feed channel 20 is in communication with the bin 17 and generally receives at least a portion of the auger 18. The feed channel 20 can include an entry portion 24, an exit portion 26, and a feed apparatus coupling 28. The feed channel 20 provides a channel for communication of material 11 through the bin 17 into the compaction apparatus 16. In particular, the entry portion 24 receives the material driven through the bin 17 by the auger 18. The exit portion 26 can be smaller in diameter than the entry portion 24 such that tapering will provide an additional degree of initial compaction as the material is forceably passed through the feed channel 20 into the compaction apparatus 12. The feed coupling 28 provides an attachment point for joining the feed apparatus 12 to the compaction apparatus 16. The auger 18 can be rotationally driven from at least one end by a motor and transmission, in forward and reverse. Various auger and like feeding devices known to one skilled in the art are envisioned for implementation with the compactor of the present invention.

The auger 18 extends from the bin 17 into the feed channel 20. The inner diameter of the feed channel 20 is some size larger than the outer diameter of the rotating auger 18 so that rotation of the auger 18 is available for the portion of the auger 18 received within the channel 20. Further, the feed coupling 28 can be implemented and connected in a modular fashion with other couplings to permit variable connectability to promote flexibility in positional configurations for the feed apparatus 12 relative to the final compaction apparatus 16. With each embodiment of the present invention 10, a chain system can be implemented wherein a chain (i.e., a barn chain) with connected paddles, and/or other devices, to carry and transport the material throughout the work environment or plant. For instance, the chain system can be implemented to carry the material into the bin 17 for further feeding through the feed apparatus 12 by the auger 18. The chain system can connect multiple material compactors 10, or it can connect or link other manufacturing, processing, or fabricating machines to the material compactor 10 to provide a line of communication of chip material from the applicable machine to the compactor 10 for compaction and liquid separation.

Alternative embodiments of the feed apparatus 12 can further include a second auger device (not shown) implemented adjacent or proximate the first auger device 18. The second auger can substantially rotatably operate in a reverse orientation to the first auger 18 such that excess material can be fed back into the bin 17 to maintain a circular feed operation. As such, material fed through and accumulated within the feed channel 20, and which is not immediately fed into the compaction apparatus 16, can be re-circulated back into the bin 17. A material feed loop is therefore created to permit generally continuous material through the feed apparatus 12 prior to traversal into the compaction apparatus 16. A material shredder device (not shown) known to those skilled in the art may be operably connected to the feed apparatus 12 such that at least some of the material within the apparatus 12 or bin 17 is further shredded to facilitate movement of large, stringy, and/or clumped material groupings through to the compaction apparatus 16.

One embodiment of the compactor 10 and the final compaction apparatus 16 is shown in FIGS. 1–12. The compaction apparatus 16 generally comprises a ramming device 30, a compaction chamber 32, a final feed channel 34, and a compaction apparatus coupling 36. The ramming device 30 is oriented for axial movement along an inner chamber cavity 54 of the compaction chamber 32, horizontal or vertical. This ramming device 30 comprises a driving means 40 for advancing a ramming portion 42 into the compaction chamber 32 and the inner chamber cavity 54. Those skilled in the art will understand the driving means 40 to include hydraulic, pneumatic, mechanically driven technology, and the like. For one mechanical embodiment of the present invention, the driving means 40 can comprise mechanically driven technology such as a punch press. Depending on the desired speed, manufacturing and energy costs, and efficiency goals, various rated/tonnage machines and shaped machines (L, H, etc.) can be utilized.

The compaction chamber 32 of one embodiment is shown in FIGS. 3–12, wherein the compaction chamber 32 includes a confronting, or opposing, first compression or compaction plate 44 and a second compression or compaction plate 46, at least one hydraulic cylinder 48, a connecting compression housing 50 and a shearing die 52. The inner chamber cavity 54 can include an entry portion 56 and a discharge port 58 distal one another.

The first compression plate 44 generally includes a first plate channel 60, a first plate entry portion 62, a first plate discharge portion 64, a first plate stepped portion 66, at least one die portion 68, at least one first plate fastening aperture 70, at least one first plate housing aperture 72, an adjustment slot/groove 74, and at least one plate fastener 76. The first plate fastening apertures 70 are capable of selectively receiving the plate fasteners 76 to provide selective securement of the first compression plate 44 with the second compression plate 46. The plate fasteners 76 can include known pins, screws, bolts, and the like for aligning, attaching, and/or securing the plates 44, 46 and other components together or in place.

The second compression plate 46 generally includes a second plate channel 80, a second plate entry portion 82, a second plate discharge portion 84, a second plate stepped portion 86, at least one die portion 88, at least one second plate fastening aperture 90, and at least one second plate housing aperture 92. The second plate fastening apertures 90 are capable of selectively receiving the plate fasteners 76 as indicated herein to secure the confrontable plates 44, 46 together. The housing apertures 72, 92 facilitate securement of the connecting compression housing 50 to at least one of the plate 44, 46 for selective tapered adjustment of the chamber 32 and inner cavity 54 proximate the housing 50. The second plate channel 60 is confrontable with the first plate channel 60 to form the channel of the inner cavity 54.

Figure 3:
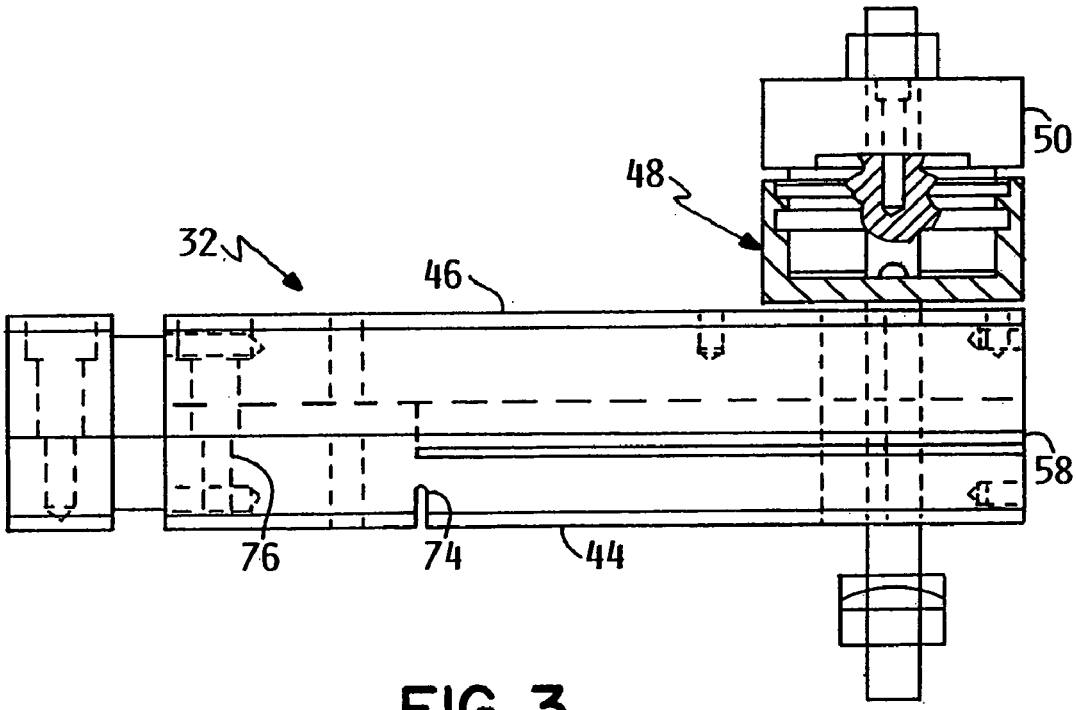
FIG. 3 is a side view of a compaction chamber in accordance with an embodiment of the present invention.
Figure 4:
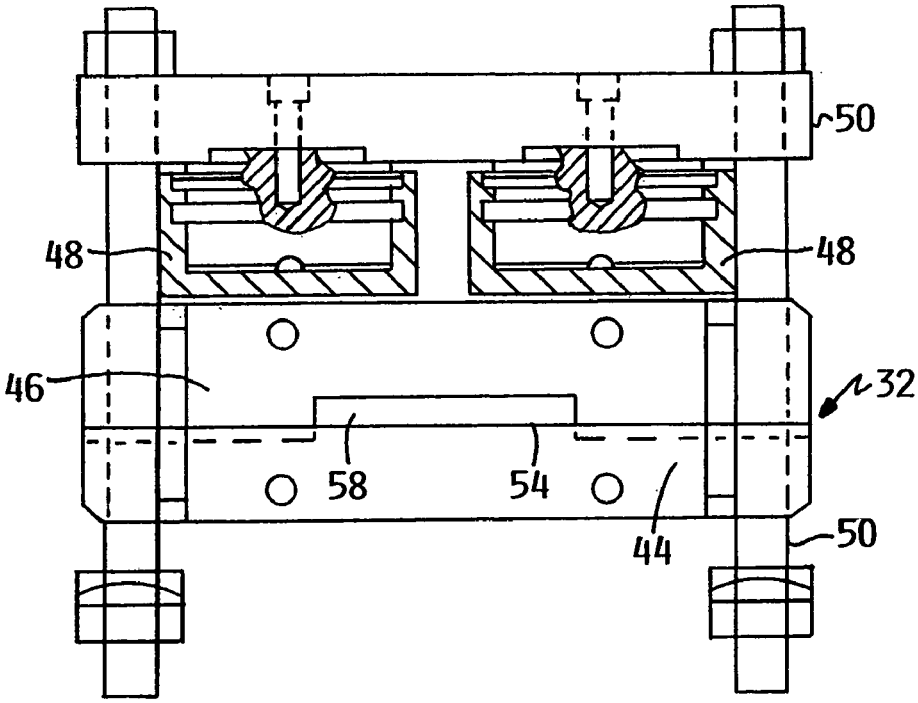
FIG. 4 is a front view of a compaction chamber in accordance with an embodiment of the present invention.

In one embodiment, the at least one device 48, such as a hydraulic cylinder 48, is adapted for operable connection proximate at least one of the plates 44, 46, and preferably the second plate 46 as demonstrated in FIGS. 3 and 4. The hydraulic cylinder 48 is operably connected to the compression housing 50 and the discharge portion 84 of the second compression plate 46. The at least one hydraulic cylinder 48 can include two cylinders capable of applying pressure down on at least one of the compression plates 44, 46, to reduce or taper the area of the inner cavity 54 at the discharge port 58. This tapering or pinching action brings the discharge portion 84 of the second compression plate 46 closer to the respective discharge portion 64 of the first compression plate 44. This tapering can create a funnelizing pressure on the material 11 contents forceably moving through the inner cavity 54. Other plate 44, 46 configurations are also envisioned such that tapered control of the inner cavity 54 at the corresponding discharge port 58 similarly is accomplished. This housing 50 can provide forceable support to facilitate the actuation of the at least one cylinder 48 down onto the second plate 46 to taper the discharge port 58 portion of the compaction chamber 32. Other known devices and techniques for performing this pressing/compression function are also envisioned to replace the cylinders 48. For instance, adjustable fastening systems, such as bolts, screws, and/or pins can be communicated through the confronting plates 44, 46 to adjust the relative proximity thereof, and the resulting taper at the discharge port 58. A myriad of other adjustment devices and systems known to one skilled in the art for compressing and adjusting the plates 44, 46 can be employed without deviating from the spirit and scope of the present invention.

Figure 6:
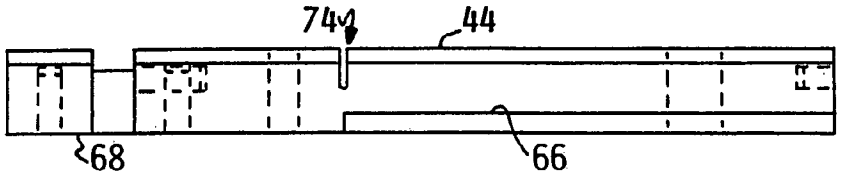
FIG. 6 is a side view of the first compaction chamber compression plate of FIG. 5.
Figure 5:
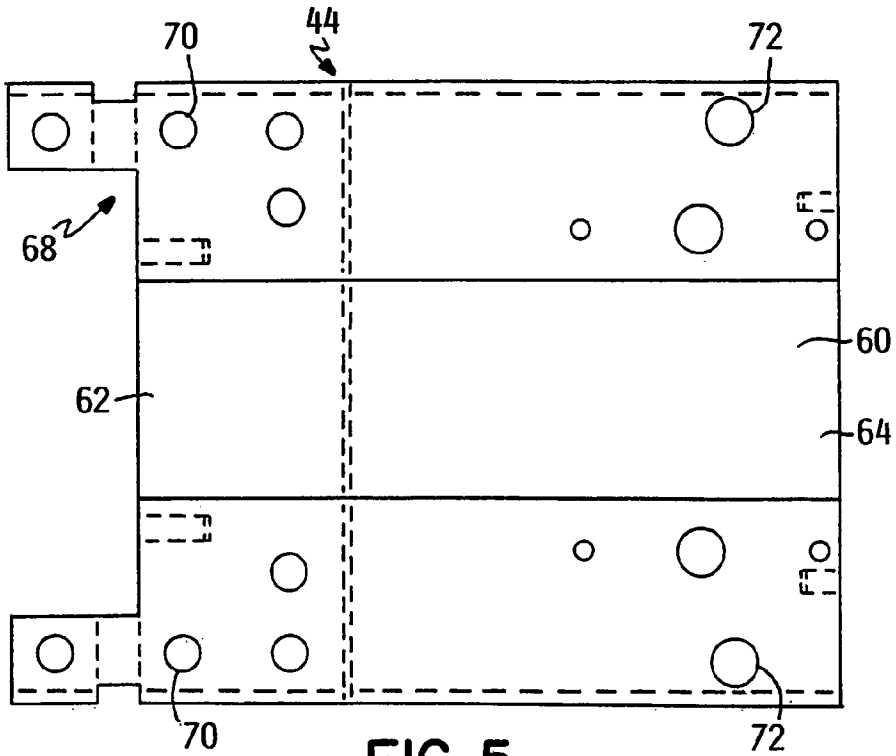
FIG. 5 is a top view of a first compaction chamber compression plate in accordance with an embodiment of the present invention.
Figure 8:
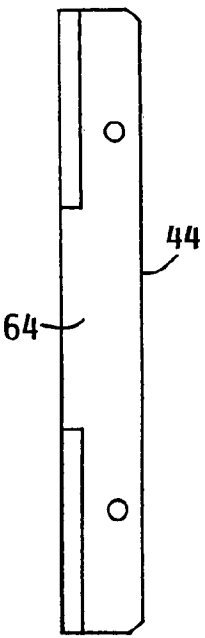
FIG. 8 is a front view of the first compaction chamber compression plate of FIG. 5.
Figure 7:
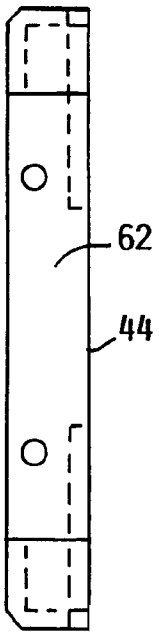
FIG. 7 is a back view of the first compaction chamber compression plate of FIG. 5.
Figure 12:
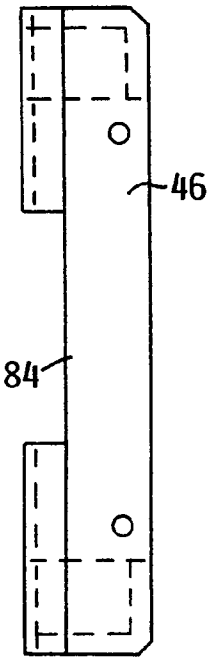
FIG. 12 is a front view of the second compaction chamber compression plate of FIG. 9.
Figure 10:
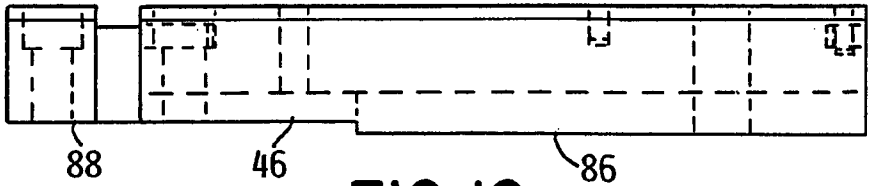
FIG. 10 is a side view of the second compaction chamber compression plate of FIG. 9.
Figure 9:
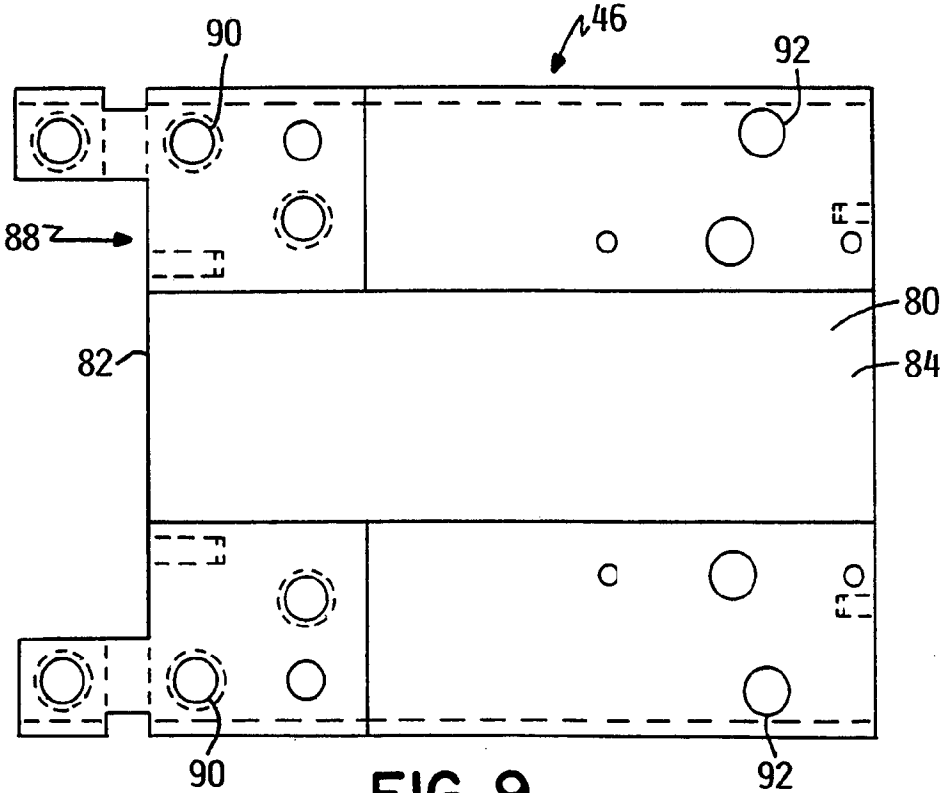
FIG. 9 is a top view of a second compaction chamber compression plate in accordance with an embodiment of the present invention.
Figure 11:
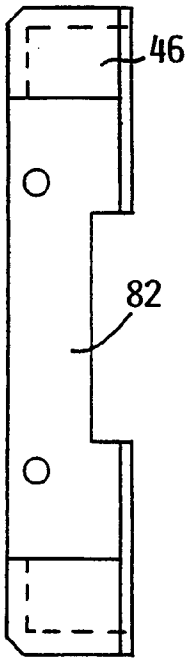
FIG. 11 is a back view of the second compaction chamber compression plate of FIG. 9.

Referring primarily to FIGS. 3, 6, and 10, the second plate 46 is longitudinally stepped along the bottom surface at the stepped portion 86 to define two levels of side material thickness. The division between the two levels of thickness can proximate the center of the longitudinal length of the plate 46, or it can be offset toward the portions 82, 84. The first plate 44 is generally similarly stepped. The top surface of the first plate 44 is confrontable and/or matable with the bottom surface of the second plate 46 in a stepped manner, measurably mirroring or mating the second plate 46 as demonstrated in FIG. 3. However, rather than providing for an exact abutment of the plates 44, 46, an axial perimeter gap 59 is generally provided along a portion of the confronted plates 44, 46. This separation of the plates 44, 46 along the gap 59 enables increased control over the compressability and taperable adjustment of the plates 44, 46 relative to one another upon actuation of the device 48. The at least one adjustment slot/groove 74 further facilitates adjustment of the plates 44, 46 and the corresponding area of the inner cavity 54 of the chamber 32 by providing for "give" or a relative bending region during compression or pressure upon the plate 46 by the operably connected compressing device 48, i.e., the hydraulic cylinder.

Figure 2A:
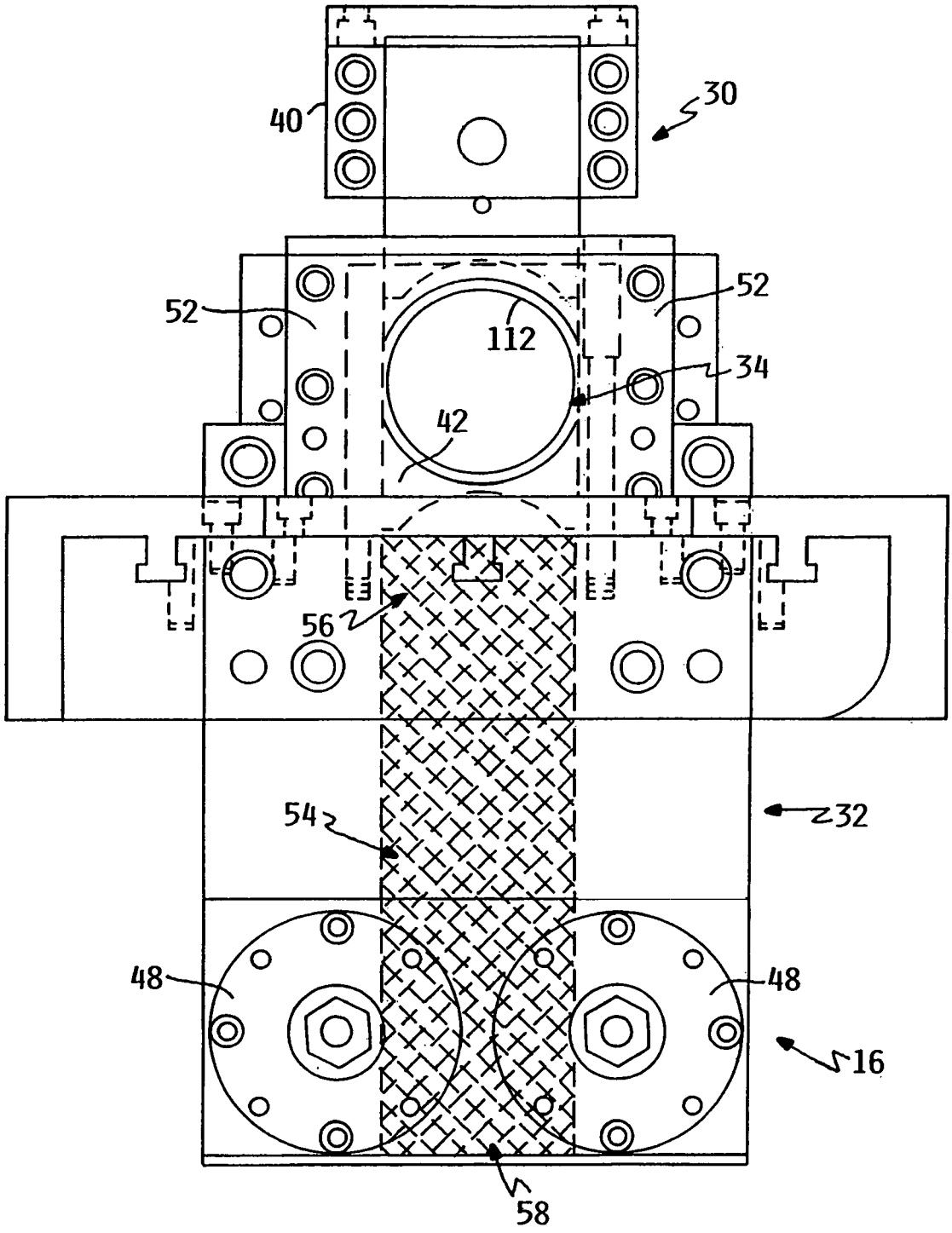
FIG. 2*a* is a top view of a compaction chamber in accordance with an embodiment of the present invention.
Figure 2B:
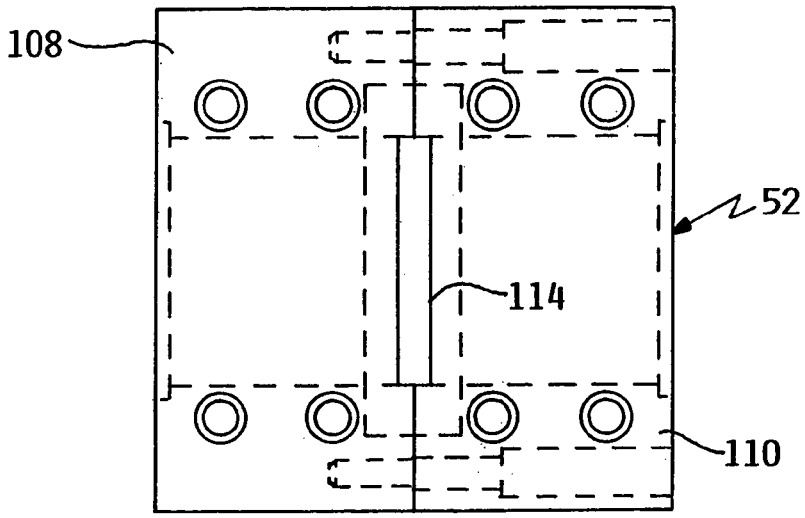
FIG. 2*b* is a top view of a shearing die holder of the compaction apparatus of an embodiment of the present invention.
Figure 2C:
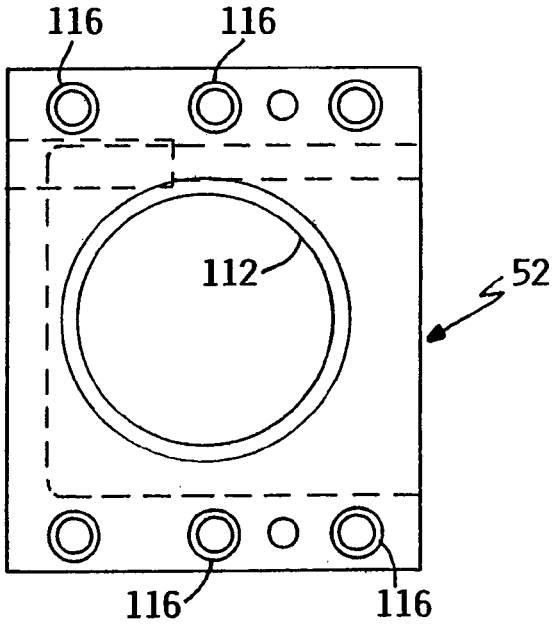
FIG. 2*c* is a side view of a shearing die holder of the compaction apparatus of an embodiment of the present invention.

A continuous communication path is created by the connecting of the feed apparatus 12 to the final compaction apparatus 16. Referring to FIGS. 2*a*–2*c*, the feed channel 20 is coupled to the final compaction apparatus 16 by securing the feed apparatus coupling 28 to the compaction apparatus coupling 36. As such, fluid communication continues from the feed channel 20 to the axially aligned final feed channel 34 and into the inner cavity 54 of the chamber 32. The final feed channel 34 can generally comprise a shearing die 52 comprised of a first die portion 108, a second die portion 110 couplable to the first die portion 108, a material entry aperture 112 defined therein, and a ram passage 114 defined therein. The shearing die 52 is couplable to the compaction chamber 32 at the corresponding die portions 68, 88. The aperture 112 and passage 114 are generally in transverse communication. Further, a plurality of mounting apertures 116 and corresponding fasteners comprise the system for coupling the die 52 to the compaction chamber 32, as shown in FIG. 2*a*. The final feed channel 34, and the material entry aperture 112, is generally transversely aligned with the axis of the inner cavity 54. Conversely, the ramming portion 42 of the ramming device 30 is disposed and aligned for axial movement along, and in and out of, the inner cavity 54 to provide the ramming force to forcibly move and compact the material 11 through the compaction chamber 32, from the entry portion 56 to the discharge port 58. The final feed channel 34 can further include internal plating systems to provide a level of "give" within the confines of the channel 34, and/or the entry aperture 112, when material 11 is moved into, and compacted within, the channel 34 before compaction through the traversely aligned compaction chamber 34. Namely, adjustable plates, spring-loaded plates, defined voids, and like techniques known to one skilled in the art enables adjustment, including dynamic adjustment, of the internal area of the final feed channel 34 upon filling with pre-compacted material 11.

Embodiments of the present invention can further include a discharge trough 100 and corresponding shrouding device coupled to, or proximately aligned with, the discharge port 58 such that a channel or material guide path is created for compacted material 11 exiting the system 10. These paths can be adjusted to feed the compacted material to storage bins, barrels, other machines, or systems and apparatus within the environment of operation to further transport and re-locate the materials 11. The shroud can protect the compacted material from fluids and other items while exiting the compacting system 10 proximate the discharge port 58.

Figure 13:
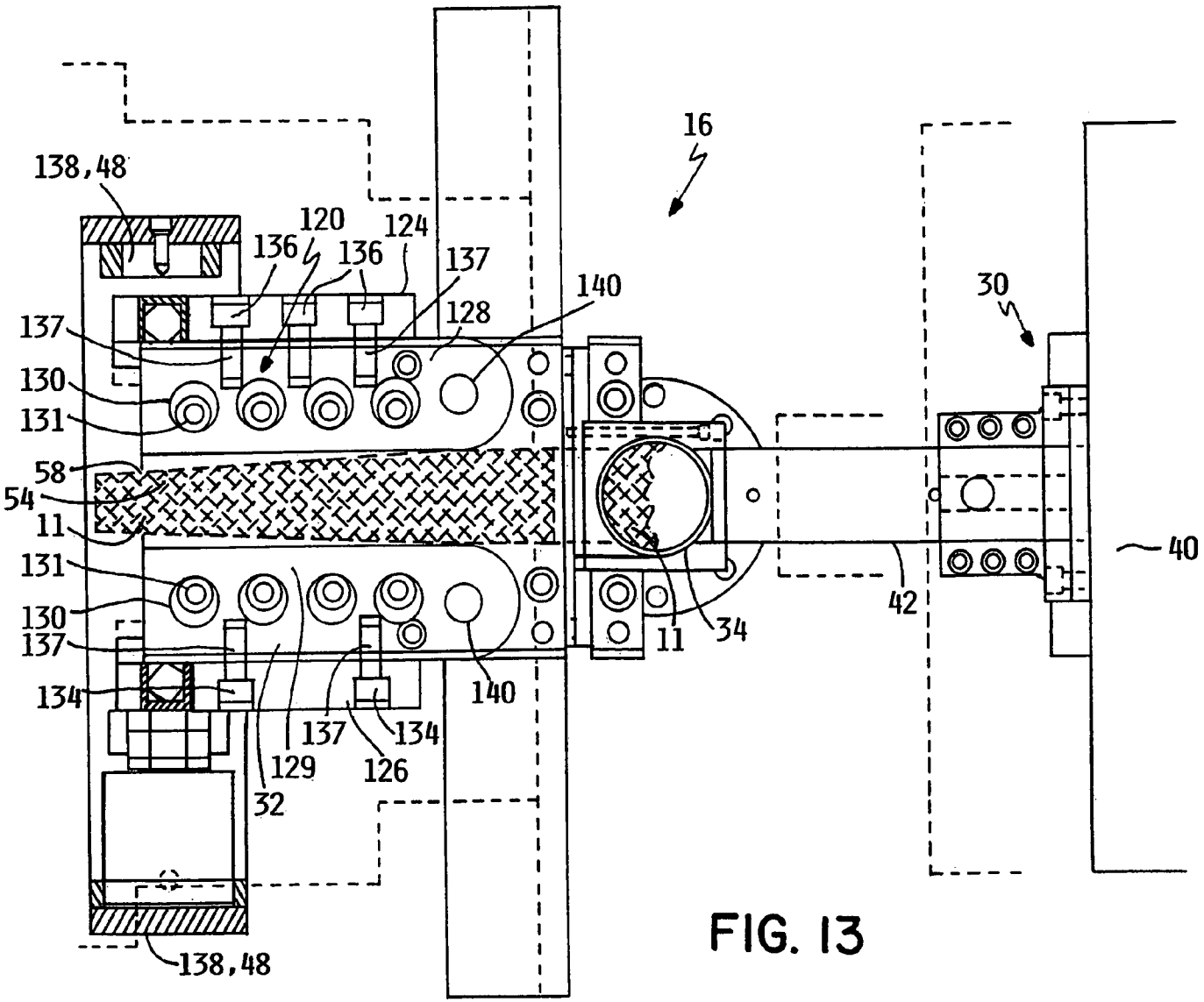
FIG. 13 is a top partial cross-section view of an embodiment of the compaction apparatus and chamber of the present invention having pivoting choke plates.

FIG. 13 shows an alternative embodiment of the compaction chamber 32. This alternative embodiment includes a chamber 32 generally defined by opposing plates 120, defining the inner cavity 54, wherein confronting pivoting choke plates 128, 129 provide the tapering adjustment of the inner cavity 54 to compactably funnelize material 11 through the chamber 32 during operation. Such an embodiment of the compaction chamber 32 can substantially include the compaction chamber, or components and structure thereof, shown and described in U.S. patent application Ser. No. 10/138,190, which has been incorporated herein by reference. The compaction chamber 32 generally includes a first side plate 124, a second side plate 126, a first choke plate 128, and a second choke plate 129. The positional configuration of these plates forms the generally rectangular inner cavity 54 or channel of the compaction chamber 32. Generally, the inner cavity 54 is defined horizontally by the inner boundaries of the spaced choke plates 128, 129 and vertically by the inner boundaries of the spaced opposing plates 120.

A plurality of oversized apertures 130 intersect the respective opposing plates 120 and choke plates 128, 129 such that substantial axial alignment of the respective apertures 130 provides a bore for receiving a corresponding one of a plurality of first fasteners 131. All fasteners described herein (for each connection and embodiment) can be a known bolt, pin, screw (i.e., socket head cap screws), and a myriad of other known fastening devices and means. The first fasteners 131 can secure the generally horizontal plates 120 with the choke plates 128, 129. However, the oversized apertures 130 are some size larger in diameter than the outside diameter of the received portion of the fasteners 131 through the choke plates 128, 129 to permit for rotational adjustment of the choke plates 128, 129 around a pivot point/pin 140. In addition, to facilitate rotation of the choke plates 128, 129, the choke plates can be made some measurable size thinner at the region proximate the choke chamber 32 such that pivoting at the pivot pin 140 is not restricted by frictional engagement of the choke plates 128, 129 against the opposing plates 120. Further, to provide a small gap between the plates 120 and the choke plates 128, 129, bushings can be inserted within the oversized apertures 130. This can provide a gap between the opposing plates 120. In addition, the bushings can provide for a start and stop position for the choke plates 128, 129 rotating in toward the inner cavity 54. To enhance liquid separation, a plurality of grooves, at various preselected angles, can be provided for in the surfaces of the choke plates 128, 129 such that liquid can be channeled into and/or away from the inner cavity 54 of the chamber 32.

The side plates 124, 126 are abuttably secured against the respective proximate plates 120 and choke plates 128, 129 by a plurality of second fasteners 134. The second fasteners 134 intersect the side plates 124, 126 through the side apertures 137 and continue some distance into the respective proximate plates 120 to provide adjustable abuttable securement. A plurality of choke plate fasteners 136 pass through the side plates 124, 126 proximate the mid-point of the generally vertical cross-section of the side plates 124, 126. In one configuration, the choke plate fasteners 136 completely pass through the side plates 124, 126 and abut the outside surface of the choke plates 128, 129 without actually penetrating the choke plates 128, 129. As such, adjustments of the choke plate fasteners 136 provides for a corresponding adjustment of the abutted choke plate 128, 129. This adjustment to the positioning or angle of the choke plates 128, 129 is made possible as a result of the oversized apertures 130 through the choke plates 128, 129. Rotational motion at the pivot points 140 of the respective choke plates 128, 129 is not impeded by the presence of the fasteners 131. It will be understood that other methods of adjusting the angles of the choke plates 128, 129 can be implemented without deviating from the spirit and scope of the present invention. For instance, the choke plate fasteners 136 could partially pass through and secure within the choke plates 128, 129 such that adjustment of the fasteners 136 in and out causes a corresponding direct angular adjustment of the choke plates 128, 129 about the pivot point 140.

Additionally, at least one adjustment or compression device 138, for instance hydraulic device 48, can be implemented at the chamber 32 to facilitate adjustment of the angular orientation of the choke plates 128, 129. With such an embodiment, the at least one hydraulic device 138 can be connected to at least one of the choke plate fasteners 136, or directly to the choke plates 128, 129 through the side plates 124, 126, wherein angular adjustment (pushing or pulling the choke plates at the expelling end) of the choke plates 128, 129 around the pivot point 140 is thereby controlled by a corresponding hydraulic movement or actuation from the device 138. Similar devices can also be implemented to facilitate angular adjustment of the choke plates 128, 129. The compaction chamber 32 and its inner cavity 54 defined by the various plates of the choke chamber 32 have a longitudinal axis generally transverse to the axis of the channel 34.

With angular adjustment around the pivot points 140 of the choke plates 128, 129, the width or distance (i.e., horizontal) across the portion of the cavity 54 at the discharge port 58 can be measurably different than the corresponding width or distance at the portions of the cavity 54 proximate the pivot points 140. Preferably, as will be discussed herein, the distance and area of the cavity 54 is adjusted to measurably increase or decrease the taper from the pivot points 140 to the discharge port 58. Similarly, the cavity 54 can be tapered for the area between the entry portion 56 and the pivot points 140. As stated, a reduction in the area is not required to provide for restricting compaction of the material 11 within the cavity 54 since the forceable advancement of the material 11 through the limited confines of the cavity 54 will provide a level of restrictive compacting by itself.

In operation, each of the embodiments of the present invention, FIGS. 1–14, utilize the taper-adjustable chamber 32 to perform effective material compaction and/or liquid separation. Unlike conventional compactors, there is no use of a gate system. In fact, the inner cavity 54 is open at the discharge port 58, there being no gate as is required in the prior art devices. Compaction and liquid separation is made possible by repeatedly forcing material 11 through the adjustably taperable final compaction chamber 32 with repeated hammering blows from the ramming device 30. Further, and unlike embodiments of the compactor of U.S. patent application Ser. No. 10/138,190, the ramming device 30 of the present invention can provide the only substantial compaction ramming. A preliminary compaction chamber and corresponding driving means/device is not required, thus reducing motion, energy, and costs.

Material 11 is initially channeled into the feed channel 20 of the feed apparatus 12 by the auger 18. The material 11 can be channeled by the auger 18 or other known means directly from and through the bin 17 and into the feed channel 20. As material 11 is directed into the entry portion 24, through the feed channel 20, and through to the material exit portion 26, the once loosely grouped chips from the bin 17 are subjected to initial compaction from the forceable movement of the chips through the limited space of the channel 20. As stated, this compaction can be further facilitated by a tapering of the channel 20 toward the exit portion 26. As the material 11 fills up the feed channel 20 and is forceably advanced to the exit portion 26, the material 11 is forced into the final feed channel 34. As material 11 is forced up against preceding material 11 in the channel 20, the material is moved through the feed channel 34 into communication with the transversely coupled compaction chamber 32 and its positioned entry portion 56. At this point, the material 11 is in a position to be rammed or compressed by the ramming portion 42 of the ramming device 30, as the ramming portion 42 travels through the final feed channel 34 and the axially aligned ram passage 114, and toward the entry portion 56 of the chamber 32.

Upon approaching the entry portion 56 of the inner cavity 54, the material 11 being fed into the entry aperture 112 is in position for repeated forceable compaction and movement through the inner cavity 54 and out the discharge port 58. With the advancement of the ram 42 of the ramming device 30, a guillotine-type motion/action occurs, wherein the motion of the ram 42 through the transversely aligned feed channel 34 and into the compaction chamber 32 pushes the material along and through the inner cavity 54 of the compaction chamber 32. Specifically, the ram 42 enters the ram passage 114 of the shearing die 52, passes into the material entry portion 112 and shears off a section of the material 11 within the channel 34 as it pushes the material 11 into the inner cavity 54. With each forceable movement of the group of material 11 through the inner cavity 54 and out the discharge port 58, it is being subjected to pressure within the cavity 54, and further compaction against leading material 11 or material groups.

The compaction chamber embodiments of FIGS. 1–12 include the inner cavity 54 formed of the spaced compression plates 44, 46. Pressure from the at least one device 48 mounted and operably connected to at least one of the plates, i.e., the second plate 46, permits adjustable tapering of the inner cavity 54 proximate the discharge port 58. Namely, pressure down on the plate 46 narrows or decreases (relative to plate 44) the area of the subject portion of the inner cavity 54 (generally considered to be the height of the cavity 54). As such, selective tapered adjustment of the inner cavity 54 toward the discharge port 58 provides for an inner cavity 54 narrower at the discharge port 58 than at the distal entry portion 56. The adjustability enabling the taper is made possible by the adjustment groove 74 and/or the axial gap 59 formed from the spatial alignment of the plates 44, 46. These structural features promote the bend or give required to taper the discharge port 58 region of the inner cavity 54 up and down. The taper will generally begin at the groove 74 and the proximate beginning portion of the axial gap 59 and decrease the internal cavity 54 area to the end portion of the axial gap 59 at the discharge port 58. The greater the taper at the discharge port 58, the tighter the compaction and liquid separation as a funnelized pressure is exerted on the passing material 11 during operation. Liquid is permitted to separate at least through the gap 59 during this forceful compression/compaction.

Figure 14:
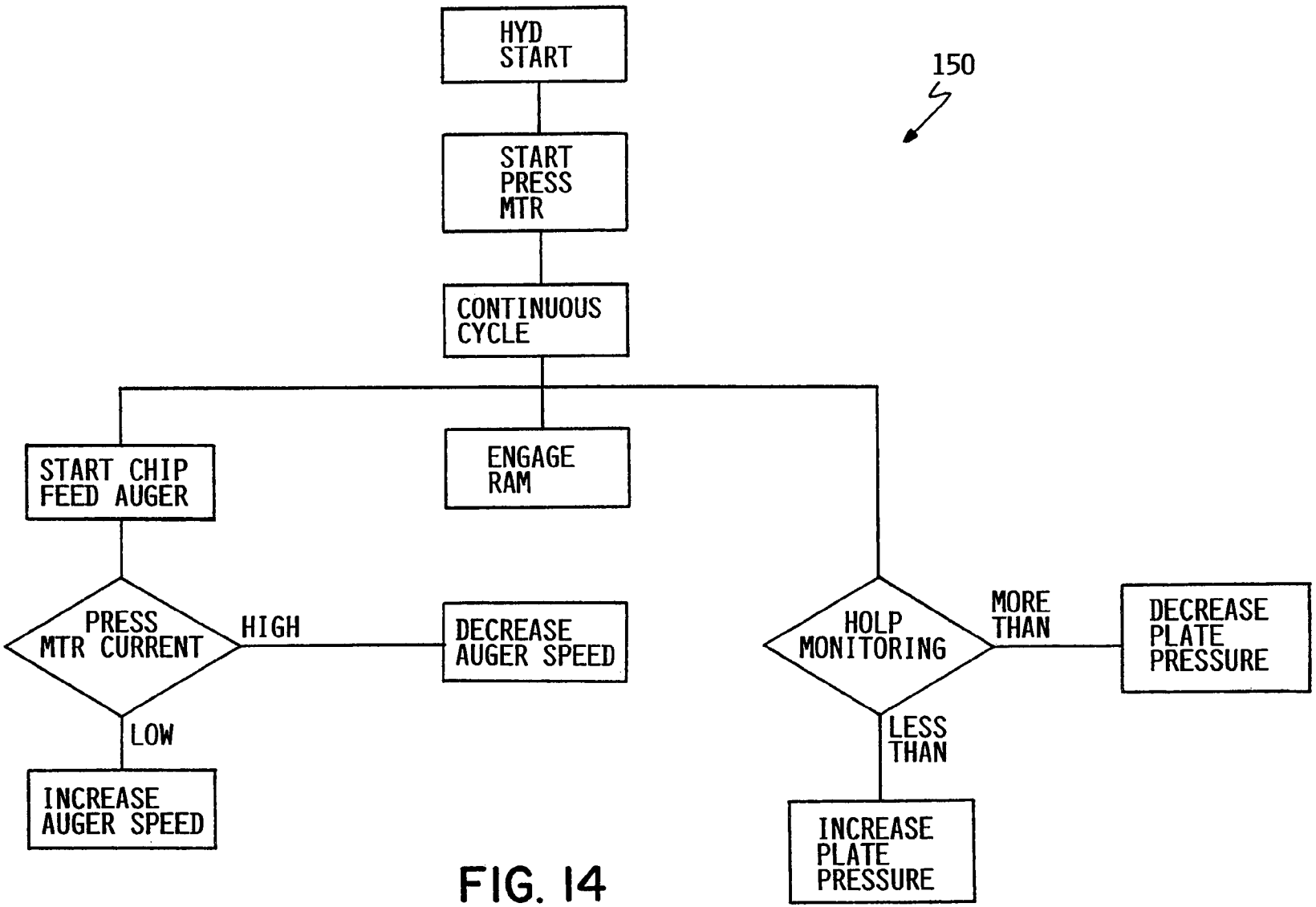
FIG. 14 is a flow chart diagram of a compaction chamber overload control system in accordance with an embodiment of the present invention.

Referring to FIG. 14, the compression or hydraulic device 48 can be operably connected to a pressure control overload system 150. The pressure control system 150 generally comprises a system of digital and/or analog controls, and/or programmable logic devices known to those skilled in the art for monitoring and controlling pressure systems, such as hydraulic, mechanical and other ramming or compression devices. The pressure regulator controls can be operably connected to the at least one device 48 to monitor and control overloads, such as those occurring during operation of the hydraulic cylinder 48. Communication between the at least one cylinder 48 and the controller system 150 permits adjustment of the load on the cylinders 48 based on a predetermined load settings/readings (i.e., maximum permitted tonnage, current, and the like) monitored through the operation of the device 30. These pressure regulators or portions of the control system 150 can be in operable communication with the ramming device or press 30 such that optimal operational tonnage of the device 30 can be maintained, and/or pressure at the hydraulic cylinder 40 can be selectively adjusted. As such readings at the press 30 (i.e., current/amperage) can be monitored to determine the parameters of the ramming operation.

Moreover, the control system 150 can be operably connected to the feed apparatus 12, and the operating motor of the auger 18 specifically, to adjust the speed of material 11 fed into the compaction apparatus 16. For instance, if overload is detected at the predetermined limit at the ramming device or press 30 (i.e., excess amperage detected at the press 30) a reduction in the press 30 operation can be initiated, adjustment can be made to the compression force applied by the cylinder 48, and/or a slow down in the feed rate of material 11 through the feed apparatus 12 can be adjusted by adjusting the auger 18 speed.

The control and monitoring schematic of FIG. 14 demonstrates an embodiment of the pressure control overload system 150 for hydraulic overload protection monitoring ("HOLP"). First, The press 30 is started and a cycle of compressing activity of the ram 42 through the compaction chamber 32 begins. At this point, the feed auger 18 can be initiated and the speed of the auger 18 can be tied into the operation of the ramming device 30. If the device 30 exceeds a programmed or predetermined parameter, or parameter range, such as a predetermined current value, the controller 150 can initiate the slow down in the auger 18 speed and/or reduce the pressure provided by the hydraulic cylinder 48 upon the chamber 32 (i.e., the second plate 46 or the choke plate 128, 129). Similarly, if the control system 150 determines that the device 30 is below the predetermined parameters, the pressure from the cylinder 48 can be increased, the auger 18 speed can be increased, and/or the ramming device 30 can be ramped up. As stated herein the monitoring parameter from the ramming device 30 can be current/amperage readings. Other known parameter monitoring variables can be employed to monitor the device 30 and the cylinder 48. Further, various other sensing systems, and means of providing pressure regulation and monitoring known to one of ordinary skill in the art can be implemented without deviating from the spirit and scope of the present invention.

The compaction chamber 32 embodiment of FIG. 13 promotes pressure or restriction on the material from the pivot points 140 to the discharge port 58 of the chamber 32. Adjustments can be made to the size or area of the inner cavity 54 proximate the discharge port 58 by angular adjustments to either of the pivotable choke plates 128, 129. In a "no-choke" configuration there is substantially no taper or reduction, or even an increase, in the area of the inner cavity 54 between the pivot points 140 and the discharge port 58. In a "choke" configuration there is a taper, and the taper is variable. A myriad of angles, and angle restrictions, are envisioned for the taper between the pivot pin 140 and the discharge port 58, depending on the particular compaction and liquid separation needs of the user. Material hardness, the power limitations of the ramming device 30, power consumption concerns, and similar goals and limitations must be considered in making such a determination. This angular adjustment is made by retreating or advancing at least one of the plurality of choke plates 128, 129 at the end proximate the discharge port 58, either manually, hydraulically, or with like means, by adjusting at least one of the fasteners 136. This results in the pivoting of the respective choke plate 128, 129 about the pivot pin 140. Compaction of the material 11 during forceable advancement through to the discharge port 58 can be achieved in a choke or no-choke configuration. Again, the pressure overload control system 150 can be implemented as well.

Each of these embodiments obviate the need for the prior art gate systems (described herein) such that the ram 42 of the present invention acts against compressed chips being restrained and further compressed by the preferably decreasing angle and area of the inner cavity 54 of the chamber 32 toward the discharge port 58. As stated, restrictive compaction pressure can even be obtained without substantially tapering the inner cavity 54 to the discharge port 58. This is possible since the grouped or preliminarily compacted material 11 can be some size larger in size than that of the area of the inner cavity 54 regardless of any tapering. Simply repeatedly pushing the material through the cavity 54 provides significant compaction and restrictive choking until the material 11 is forced out the open discharge port 58.

With each embodiment, the material 11 can receive compaction hits for a period of minutes before being ejected from the final compaction apparatus 16 at the discharge port 58. With each compaction hit, a new guillotined slice/cube of material 11 is thrust into the final compaction chamber 32 and an existing slice is moved through the inner cavity 54 toward ejection from the discharge port 58 such that slices are being repetitively compacted against preceding or leading slices with each hit of the ram 42.

It is also envisioned that the embodiments of the final compaction chamber 32 need not necessarily be distinct. Simply put, the features can be combined such that a chamber 32 is capable of both up and down (compression of plates 44, 46) and lateral (compression pivoting of plates 128, 129) tapering of the area of inner cavity 54. The structural components of the embodiments of FIGS. 1–12 can be selectively combined with the structural components of the embodiment of FIG. 13 to create such a multidimensional tapering material compaction apparatus.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A material compactor for compacting or separating liquid from comminuted material, the compactor comprising:

a material feed apparatus adapted to transport the comminuted material into a compaction apparatus, the material feed apparatus having a bin and an auger to subject the comminuted material to a preliminary level of compaction;

the compaction apparatus adapted to receive the comminuted material from the material feed apparatus, the compaction apparatus having;

a compacting ram adapted to subject the comminuted material to a plurality of compacting hits; and an adjustably taperable compaction chamber having an inner cavity defined by first and second opposed compaction plates, the inner cavity having a material entry portion and a continuously open discharge port, wherein the compaction chamber further includes a longitudinal gap provided along a length of and between the first and second opposed compaction plates, and a groove provided generally transverse with respect to the longitudinal gap and extending into and across an outer surface of at least one of the first and second opposed compaction plates proximate the material entry portion, the longitudinal gap and the transverse groove together facilitating adjustment of the first and second opposed compaction plates by an external compression force to selectively adjust tapering of the inner cavity proximate the open discharge port such that the comminuted material within the inner cavity of the chamber is subject to funnelized pressure by the compacting hits of the compacting ram until the comminuted material is forced from the compaction chamber at the open discharge port.

2. The compactor of claim 1, wherein the compacting ram of the compaction apparatus is driven by a mechanical punch press.

3. The compactor of claim 1, wherein the compaction apparatus includes at least one hydraulic device operably connected to at least one of the compaction plates proximate the open discharge port to control the external compression force for the selective adjustment of the inner cavity proximate the open discharge port.

4. The compactor of claim 3, wherein the at least one hydraulic device is adapted to expand and contract the compaction plates relative to each other to selectively adjust the area of the inner cavity proximate the open discharge port.

5. The compactor of claim 1, wherein the material feed apparatus and the compaction apparatus are transversely aligned.

6. The compactor of claim 3, further including an overload control system in operable communication with the ram and the at least one hydraulic device to monitor the operation of the ram and selectively control the external compression force for the selective adjustment of the inner cavity.

7. A compaction device for receiving a comminuted material to be compacted, the compaction device comprising:

a ram being repeatedly translatable through a stroke of known length;

an external compression device; and an adjustably taperable chamber adapted to operably receive the ram, the chamber having two confronting plates defining a material inlet portion of known area and a gateless material discharge port of known area, one of the confronting plates having a groove formed into and along an outer surface thereof, the groove extending generally transverse to a longitudinal axis of the one confronting plate such that the gateless material discharge port area is taperable by adjustable displacement of the two confronting plates with respect to each other through bending of the one confronting plate at the groove by a force application from the external compression device.

8. The device of claim 7, wherein the external compression device includes at least one hydraulic device operably connected to the adjustably taperable chamber proximate the gateless material discharge port to control the force application.

9. The device of claim 8, wherein the at least one hydraulic device is adapted to expand and contract the compression plates relative to each other to selectively adjust the area of the gateless material discharge port.

10. The device of claim 7, wherein the ram is mechanically driven.

11. The device of claim 7, further including an overload control system in operable communication with the compression device to monitor predetermined operational criteria of the ram within the chamber to selectively control the tapering of the gateless material discharge port.

12. A compaction device for receiving a material to be compacted, the compaction device comprising:

a ram being repeatedly translatable through a stroke of known length; and a compaction chamber being operably coupled to the ram, the chamber having opposed abuttable compaction plates defining an inner chamber cavity, with one of the opposed compaction plates including a bending groove formed in and along an outer surface thereof to facilitate taperable adjustment of the inner chamber cavity from the bending groove to an open discharge port, the chamber further including a hydraulic device operably coupled thereto to exert a force application upon the chamber to adjust the taper of the inner chamber cavity, wherein the material is advanced through the inner chamber cavity by the ram and the material is subjected to compression forces until being expelled out the open discharge port; and a control system in operable communication with the hydraulic device and the ram to monitor operational criteria of the ram as the material is advanced through the inner chamber cavity and to selectively control the force application exerted upon the chamber by the hydraulic device to adjust the taper of the inner chamber cavity from the bending groove to the open discharge port.

13. The compaction device of claim 12, further including a material feed apparatus operably connected to the chamber to transport material into the inner chamber cavity, the transporting of the material through the material feed apparatus providing an initial level of compaction on the material.

14. The compaction device of claim 13, wherein the material feed apparatus includes a bin and an auger.

15. The compaction device of claim 13, wherein the material feed apparatus and the chamber are in transverse communication with one another.

16. The compaction device of claim 12, wherein the control system controls the force application exerted upon the chamber by the hydraulic device based on an operational amperage reading for the ram.

17. The compaction device of claim 12, wherein the control system controls the force application exerted upon the chamber by the hydraulic device based on an operational tonnage reading for the ram.

18. A material compactor for compacting and separating liquid from comminuted material, the compactor comprising:

means for directing and providing a preliminary level of compaction on the comminuted material; and a compaction apparatus having:

first means for subjecting the material to a plurality of compacting hits; and an adjustably taperable chamber having means for compression operably coupled thereto, the adjustably taperable chamber having opposed first and second compression plates to define an inner cavity with a material entry portion and a continuously open discharge port, the adjustably taperable chamber further having a longitudinal gap formed between and along a length of the first and second compression plates, and a groove extending generally transverse to the longitudinal gap and the groove extending into and along an outer surface of the first compression plate to facilitate displacement of the first plate with respect to the second plate such that selective adjustment of the means for compression tapers a portion of the chamber and the longitudinal gap proximate the open discharge port to subject the comminuted material to compression forces by the compacting hits of the first means until the comminuted material is forced from the chamber at the open discharge port.

19. The compactor of claim 18, wherein the means for compression includes at least one hydraulic device operably coupled to the adjustably taperable chamber proximate the open discharge port.

20. The compactor of claim 18, wherein the means for directing the comminuted material includes a bin and auger, and is transversely communicatably coupled with the adjustably taperable chamber.

21. The compactor of claim 19, further including control means in operable communication with the means for compression for monitoring and controlling the tapering of the adjustably taperable chamber.

22. A method of compacting material through a material compaction apparatus, comprising the steps of:

directing material into an inner cavity of an adjustably taperable compaction chamber wherein an area of the inner cavity of the compaction chamber is at least partially defined by first and second confronting plates having a longitudinal gap therebetween, with the first confronting plate having a groove extending generally transverse to the longitudinal gap and the groove extending into and along an outer surface of the first confronting plate, the compaction chamber being taperable proximate a gateless material discharge port by pivoting the first plate with respect to the second plate at the groove by way of a compression device operably coupled to the chamber to taper the longitudinal gap and the area of the inner cavity proximate the gateless material discharge port;

repeatedly advancing a compaction ram through a portion of the inner cavity of the compaction chamber such that the material is subjected to compacting resistance within the inner cavity proximate the gateless discharge port until being expelled out the chamber through the gateless discharge port; and controlling the compression of the compression device based on monitoring of operational criteria of the compaction ram.

23. The method of claim 22, wherein pivoting the first plate at the groove by way of the compression device includes applying pressure to the first plate by a hydraulic device operably connected to the compaction chamber.

24. The method of claim 23, wherein controlling the compression of the compression device based on monitoring of operational criteria includes controlling the pressure applied by the hydraulic device based on a predetermined operational tonnage for the compaction ram.

25. The method of claim 22, wherein directing the material into the inner cavity includes directing the material with an auger through a material feed apparatus such that the material is subjected to a preliminary level of compaction prior to entering the inner cavity of the compaction chamber.

26. The method of claim 23, wherein controlling the compression of the compression device based on monitoring of operational criteria includes controlling the pressure applied by the hydraulic device based on a predetermined operational amperage for the compaction ram.

27. The method of claim 25, wherein the material feed apparatus and the compaction chamber are transversely operably connected.

* * * * *